US006494820B2

(12) United States Patent
Orlando

(10) Patent No.: US 6,494,820 B2
(45) Date of Patent: Dec. 17, 2002

(54) SPORTS CLUB TRAINER ARRANGEMENT

(76) Inventor: Joseph M. Orlando, 1 Western Ave., Gloucester, MA (US) 01930

( * ) Notice: Subject to any disclaimer, the term of this patent is extended or adjusted under 35 U.S.C. 154(b) by 57 days.

(21) Appl. No.: 09/740,769

(22) Filed: Dec. 19, 2000

(65) Prior Publication Data

US 2002/0077232 A1 Jun. 20, 2002

(51) Int. Cl.[7] ..... A63B 71/00
(52) U.S. Cl. ..... 482/148; 482/83
(58) Field of Search ..... 482/148, 83; D21/246, D21/799; 473/415, 131, 478, 490, 459, 524; 273/108.2, 317.6, 108.1, 1.5 R, 1.5 A, 25, 26 R; 472/118; 160/330, 335, 338, 336

(56) References Cited

U.S. PATENT DOCUMENTS 1,166,496 A * 1/1916 Torrey ..... 473/219
3,227,449 A * 1/1966 Schwab ..... 272/55
5,116,056 A * 5/1992 Schmutte ..... 272/181 F
5,839,733 A * 11/1998 Meeks et al. ..... 273/400
6,165,085 A * 12/2000 Lubin ..... 473/478
6,280,351 B1 * 8/2001 Wong ..... 473/422
6,352,481 B1 * 3/2002 Pak ..... 473/219

* cited by examiner

*Primary Examiner*—Michael A. Brown
*Assistant Examiner*—Lori Baker Amerson
(74) *Attorney, Agent, or Firm*—Dn Halgren

(57) ABSTRACT

The present invention relates to a swing trainer apparatus for the teaching of a sport player the power "follow-through" of a swing to hit a ball or puck. The swing trainer apparatus comprises a supportable frame and a plurality of webs supported from the frame. The webs defining a swing zone through which the training player must fully empower and continue his/her swing, to order to practice and improve that swing. The webs are made of an elongated flexible material and hang downwardly from the frame.

16 Claims, 4 Drawing Sheets

SPORTS CLUB TRAINER ARRANGEMENT

BACKGROUND OF THE INVENTION

1. Field of the Invention

This invention relates to an apparatus for improving the swing of a player utilizing a sports bat, club or racquet.

2. Prior Art

Being successful in any sport requires concentration, muscle development and "follow-through", particularly in those sports utilizing a bat, club, or a racquet. "Follow-through" may be defined as completing the swing of that bat, club or racquet through an arc from an initial start position, then around and into the strike zone, and thereafter maintaining that swing until the player's arm has been fully extended. The necessity for such follow-through is often a requirement for directing the ball or puck in the direction in which the player has intended and for providing the power to drive the ball or puck with maximum force. Such follow-through, though, is a difficult lesson to learn and to remember. Muscle memory would ensure that such follow through would take place if the player could in fact develop such a muscle memory capability.

The sports of baseball, golf, tennis, and hockey all require an arcuate and full swing of a bat, club, or racquet. Other body motion other than movement of the arm is also required. It is thus significant to instill in the player, a muscle memory so that such follow through becomes automatic.

There exists no arrangement or apparatus to instill upon the player, the reminder that the follow-through be undertaken each time, except for a coach or personal trainer who must otherwise be present during practice or playing and remind that player each time a swing is undertaken.

It is an object of the present invention to provide an apparatus which will provide a sport player with the follow-through skills necessary which are not taught by the prior art.

It is a further object of the present invention to provide a sport skill training device which does not require assistance to operate.

It is still yet a further object of the present invention to provide a training apparatus which is adaptable to a number of sports so that its use may be appreciated by a number of different players.

It is a still yet further object of the present invention to provide a sport training apparatus which is stepwise adaptable to the improving skill level of the particular player or user of that apparatus.

BRIEF SUMMARY OF THE INVENTION

The present invention comprises a moveably supported swing trainer apparatus for instructing a player of baseball, tennis, hockey, or golf in lessons of following through with the swing of their bat, racket, club, or stick. The swing trainer apparatus in its most general form, comprises a rectilinearly shaped frame arrangement defining a periphery of the swing trainer apparatus. A plurality of removable support rods are arranged across the frame in a parallel and spaced apart manner, so as to be supported therein in generally horizontally. The removable support rods each have an end portion which is matable with an opening spaced apart from one another around the frame.

A plurality of elongated web-like members, each of which may be comprised of for example, plastic straps, leather strips, heavy canvas, rope or the like, are attached at an upper end thereof, to the support rods. The elongated webs are preferably about two to three feet in length, and an inch to two inches wide. The elongated webs may also be draped over the removable sport rods in an inverted "U" shape orientation.

The plurality of support rods are disposed in the frame structure in a parallel and spaced-apart manner. Those elongated webs are disposed on each support rod preferably spaced slightly apart from one another as they extend across portions of the frame. Each support rod is spaced apart from its adjacent support rod and may have different types of web supported therefrom going from one support rod to an adjacent support rod.

In facing the swing trainer apparatus, the down-hanging webs provide a generally rectangular area defining a "sweet spot", into which the bat, racquet, stick, or club is to be swung. In an initial use of the swing trainer apparatus by a beginner level player, it is contemplated that only one or two parallel support rods would be carrying or supporting any down-hanging or elongated webs. The sport player, in use of the swing trainer apparatus, swings thereat and follows through with the swing to make sure that by the swing, he/she makes sure that each successive adjacent row of downwardly supported webs are all passed through or brushed by the club, bat, racquet, or stick with a strong and equal force. The webs hanging down from the swing trainer apparatus will make a sound as they are struck, and they will move and swing in response to being struck, thus providing both a visual and an audible indicator to the player that all successive webs have been hit. Swing practice in this manner provides the "muscle memory" to the player. As the player advances in his or her skills, additional successive rows of downwardly hanging elongated webs may be supported on adjacent support rods extending across the frame. When those webs are struck by the swing of the player, they provide a resistance through an arcuate path of the player's swing of the club, racquet, bat, or stick. Thus the enhancement to the musculature of the player and the muscle memory to affect a full swing and follow through in an automatic fashion.

In a general embodiment of the present invention, the front panel of the down-hanging webs have a sweet spot or mid-portion which is in line with the likely preferred swing of the club, bat, racquet, or stick. It is to be noted that such a swing trainer apparatus may be supported from a ceiling, tree, rafter, pole, or the like in a stationary manner and in a limited space.

In a further embodiment of the present invention, the swing trainer apparatus may be supported by its support lines from an overhead support apparatus. The overhead support apparatus may in one instance comprise for example, an elongated swivel arm having a distalmost end from which the swing trainer apparatus may be suspended. An attachment cable may extend from a ring at the high end of the support line and be connected to the distal end of the swivel arm. The swivel arm may be arranged on a support column which is swingable about an arc back and forth so as to swing toward and/or away from the player, and may be moveable in an upwardly or a downwardly direction by a vertical actuator mechanism arranged between the support column and the swivel arm. Such a motion may be controlled by a random drive computer within the drive unit. The distal end of the swivel arm may be telescopable so as to permit the swing trainer apparatus to be moved from side to side of the player as well as away and toward that player while the player is attempting to swing the bat, racquet, club, or stick. Depending upon the height of the swing trainer apparatus on the ground to an upper level at shoulder height would thus permit a player to play hockey, tennis, baseball, or golf swing training.

Thus, what has been shown is a unique swing trainer apparatus, which permits the individual sport player to train by himself or herself to develop muscular control and follow through in the arcuate swing of a racquet, bat, club, or stick necessary to properly play many sports. The swing trainer apparatus is adaptable to beginning level players as well as seasoned veterans, by adding or removing parallel rows of downwardly supported web members of elongated flexible material from the support rods extending across the frame. Articulation of the swing trainer apparatus by an overhead support mechanism permits a random motion to the swing trainer apparatus, thus additionally training the player in foot movement and concentration in addition to the swing follow through.

The invention thus comprises a swing trainer apparatus for the teaching of a sport player the follow-through of a swing to hit a ball or puck. The swing trainer apparatus comprises a supportable frame and a plurality of webs supported from said frame, the webs defining a swing zone through which the player must fully and forcefully swing to practice and improve that swing. The webs are comprised of an elongated flexible material. The frame includes a plurality of support rods extending thereacross and wherein the webs of material are distributed thereon in a spaced-apart manner. The support rods are arranged across the frame in a parallel and spaced-apart manner. The support rods may be removably replacable in the frame. The webs may be selected from the group comprised of: strips of plastic, strips of woven material, rope and leather or the like. An arrangement of overhead support lines are attached to the frame for supporting the swing trainer apparatus from a ceiling or an overhead support. The overhead support may be movable to provide a moving target into which a player may swing. The overhead support may comprise an articulable arm which is swingable about an arc, up and down and left and right to provide the swing trainer apparatus as a movable sweet-spot target.

The invention also comprises a method of improving the swing and follow-through of a player using a bat, racquet, club or stick against a ball or puck. The method may comprise the steps of arranging a three-dimensional array of web members supported by a frame, which web members provide a sweet spot target, and swinging at the sweet spot of the web members by a holder of the bat, racquet, club or stick, to teach the holder to swing and follow all the way through the array of web members. The method may include the steps of: adding a row of web members to the array of web members supported by the frame, removing a row of web members from the array of web members supported by the frame, changing the physical characteristics of adjacent web members supported on the frame to impart different resistance to a swing through the web members, moving the frame supporting the web members so as to provide a moving sweet spot target to the holder of the club, bat, racquet or stick. The frame may be supported on an articulable arm member arranged to be swingable so as to provide movement to the webs.

BRIEF DESCRIPTION OF THE DRAWINGS

The objects and advantages of the present invention will become more apparent when viewed in conjunction with the following drawings, in which.

DETAILED DESCRIPTION OF THE PREFERRED EMBODIMENTS

Figure 1:
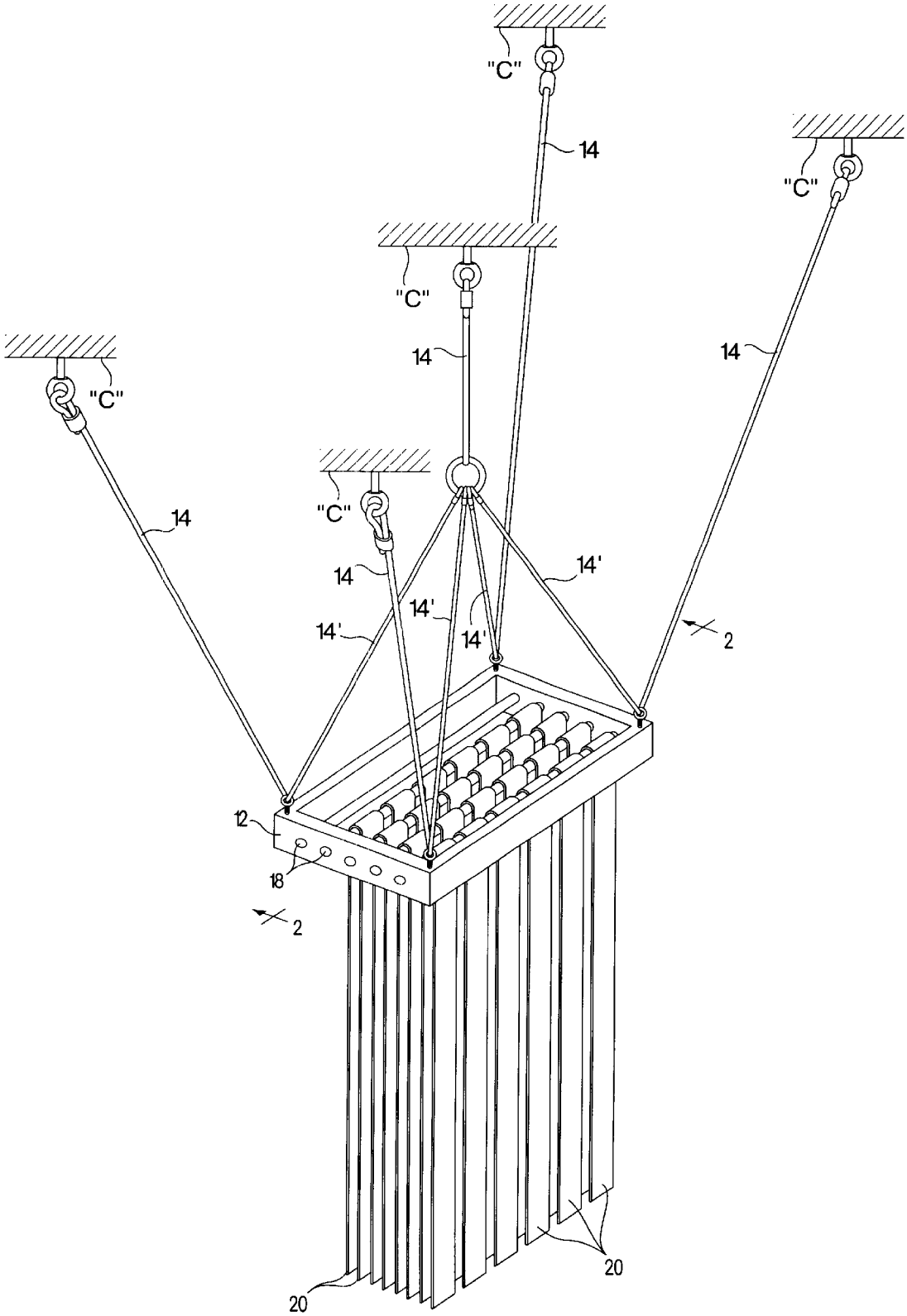
FIG. 1 is a perspective view of a swing trainer apparatus constructed according to the principles of the present invention.

Referring now to the drawings in detail, and particularly to FIG. 1, there is shown the present invention which comprises a moveably supported swing trainer apparatus 10 for instructing a player "P" of baseball, tennis, hockey, or golf in lessons of "following through" with the swing of their bat, racket, club, or stick. The swing trainer apparatus 10 in its most general form, comprises a rectilinearly shaped frame 12 defining a periphery of the swing trainer apparatus 10. The swing trainer apparatus 10 is supported by a plurality of support lines 14 preferably spread out and attached to an overhead support such as a ceiling "C" or the like, for stability preferably arranged to hold the frame 12 in a generally aligned and non-twisting manner, as shown in FIG. 1. Alternatively, an array of support lines 14' may be brought to a common point or ring "R" and supported from the ceiling "C" or the like, as is also shown in FIG. 1.

A plurality of removable support rods 16 are arranged across the frame 12 in a parallel and spaced apart manner, as may be seen in FIG. 1, so as to be supported therein generally horizontally. The removable support rods 16 each have an end which is matable with an opening 18 spaced apart from one another around the frame 12.

Figure 2:
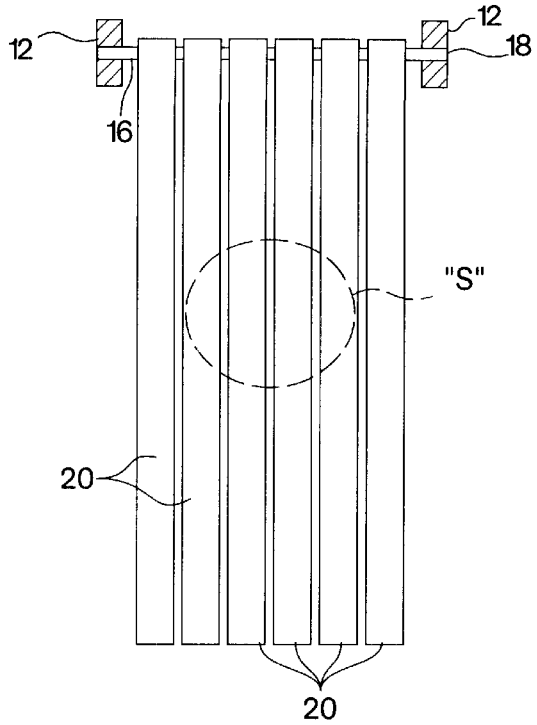
FIG. 2 is a view taken along the lines 2—2 of FIG. 1.

A plurality of elongated web-like members 20, each of which may be comprised of for example, plastic straps, leather strips, heavy canvas, rope or the like, are attached at an upper end thereof, to the support rods 16, as is shown in FIGS. 1 and 2. The elongated webs 20 are preferably about two to three feet in length, and an inch to two inches wide. The elongated webs 20 may also be draped over the removable sport rods in an inverted "U" shape orientation, as shown in FIG. 1.

The plurality of support rods 16 are disposed in the frame 12 in a parallel and spaced-apart manner. Those elongated webs 20 are disposed on each support rod preferably spaced slightly apart from one another as they extend across opposed portions of the frame 12. Each support rod 16 is spaced apart from its adjacent support rod 16 and in an alternative embodiment, and may have a different type (texture difference, heavier, stiffer, sound emitting, louder, light emitting, colored and/or softer) of web 20 supported therefrom going from one support rod 16 to an adjacent support rod 16.

In facing the swing trainer apparatus, the down-hanging webs provide a generally rectangular area defining a "sweet spot" "S" as represented in FIG. 2, into which the bat, racquet, stick, or club is to be swung. In an initial use of the swing trainer apparatus by a beginner level player "P", it is contemplated that maybe only one or two parallel support rods 16 would be loaded and carrying or supporting any downhanging or elongated webs 20.

Figure 4:
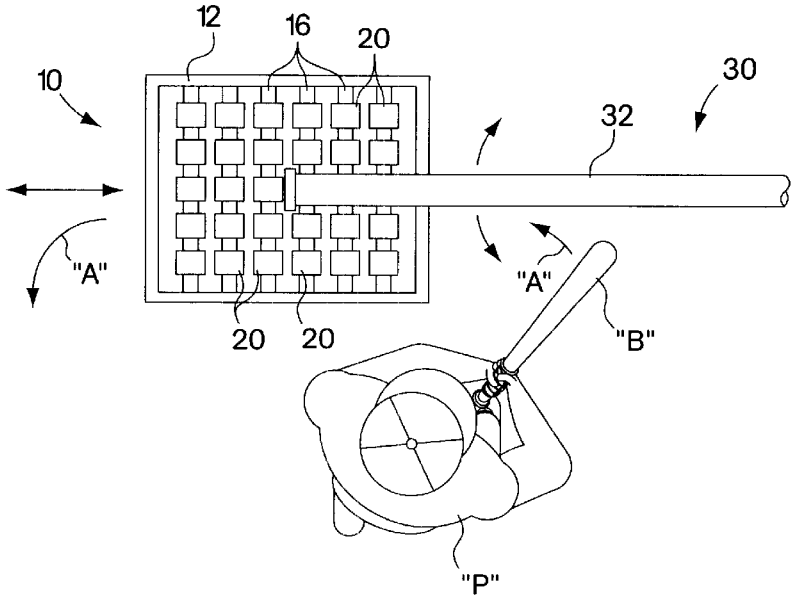
FIG. 4 is a plan view of the moveable swing trainer apparatus shown in FIG. 3, with the relationship of a player thereadjacent.

The sport player "P", in use of the swing trainer apparatus as represented in FIG. 4, swings the bat, club or racquet "B" thereat through an arc "A" and follows-through with the swing to make sure that by the swing, the player "P" makes sure that each successive adjacent row of downwardly supported webs 20 is passed through or brushed by the club, bat, racquet, or stick "B". The webs 20 hanging down from the swing trainer apparatus 10 will make a sound as they are struck, and they will move and swing in response to being struck, thus providing both a visual and an audible indicator to the player that all successive webs have been hit. Swing practice in this manner provides the "muscle memory" to the player. As the player advances in his or her skills, additional successive rows of downwardly hanging elongated webs 20 may be supported on adjacent support rods 16 extending across the frame 12. When those webs 20 are struck by the swing of the player "P", they provide a resistance through an arcuate path "A" of the player's swing of the club, racquet, bat, or stick "B". Thus the enhancement to the musculature of the player and the muscle memory to affect a full swing and power follow-through in an automatic fashion is accomplished by such swing trainer apparatus.

In a general embodiment of the present invention, the front panel of the down-hanging webs 20 have the sweet spot "S" or mid-portion which is adjustable so as to be in proper vertical alignment with the likely preferred swing of the club, bat, racquet, or stick "B". It is to be noted that such a swing trainer apparatus may be supported from a tree, rafter, or pole, or the like in a stationary manner and adjusted by its support lines 14.

Figure 3:
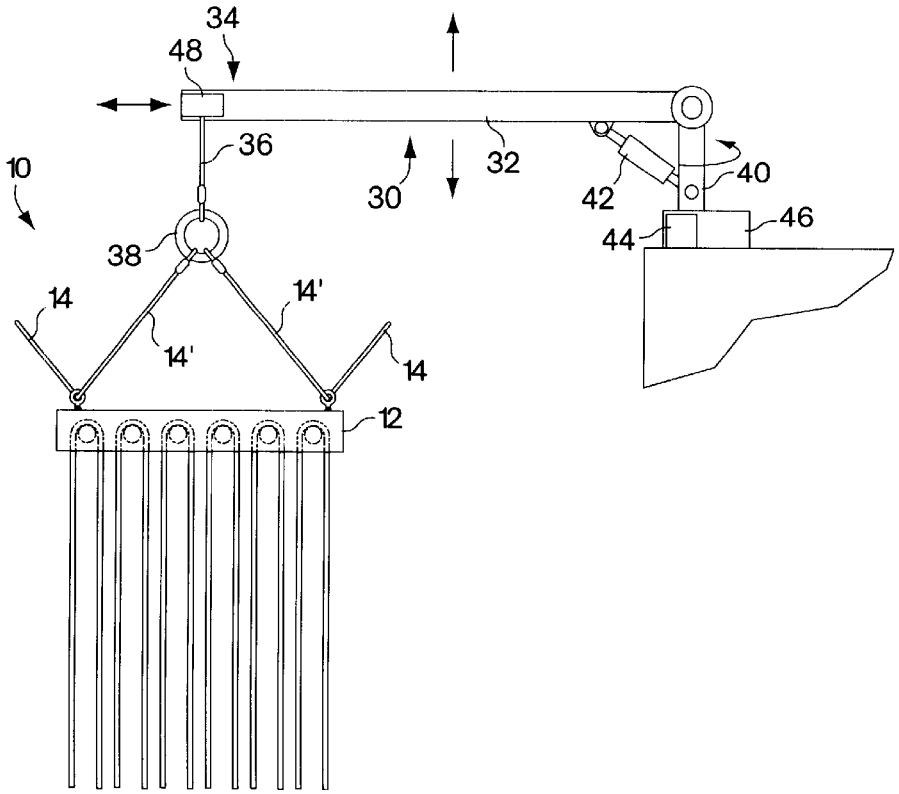
FIG. 3 is a side elevational view of the swing trainer apparatus arranged in a moveable configuration.

In a further embodiment of the present invention, the swing trainer apparatus 10 may be supported by its support lines 14 from an overhead support apparatus 30, as represented in FIG. 3. The overhead support apparatus 30 may in one instance comprise for example, an elongated swivel arm 32 having a distalmost end 34 from which the swing trainer apparatus 10 may be suspended. An attachment cable 36 may extend from a ring 38 at the high end of each of the support lines 14 and be connected to the distal end 34 of the swivel arm 32. The swivel arm 32 may be arranged on a support column 40 which is swingable about an arc back and forth so as to swing toward and/or away from the player "P" as represented in FIGS. 3 and 4, and may be moveable in an upwardly or a downwardly direction by a vertical actuator mechanism 42 arranged between the support column 40 and the swivel arm 32. Such a motion may be controlled by a random drive computer 44 within the drive unit 46. The distal end 34 of the swivel arm 32 may have a telescopable member 48 thereon, so as to permit the swing trainer apparatus 10 to be moved from side to side of the player as well as away and toward that player while the player is attempting to swing the bat, racquet, club, or stick fully through all of the array of web members 20 supported downwardly from the frame 12. Depending upon the height of the swing trainer apparatus 10, for example, on the ground, to an upper level at shoulder height, such adjustable level or height would thus permit a player to have hockey, tennis, baseball, or golf swing training.

Figure 5:
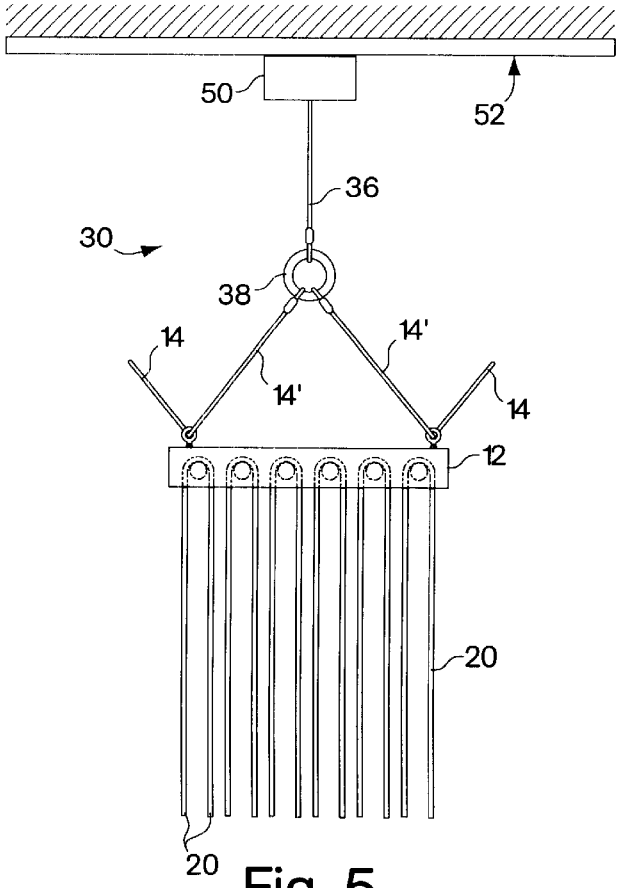
FIG. 5 is a side elevational view of a further embodiment of the present invention showing it in its overhead supported orientation.

A further embodiment of the support apparatus 30 may be comprised of a trolley 50 carried on an overhead track 52 or the like, as represented in FIG. 5. The trolley 50 may be moved in the track 52 and movably support the swing trainer apparatus 10 side to side and/or up and down.

Figure 6:
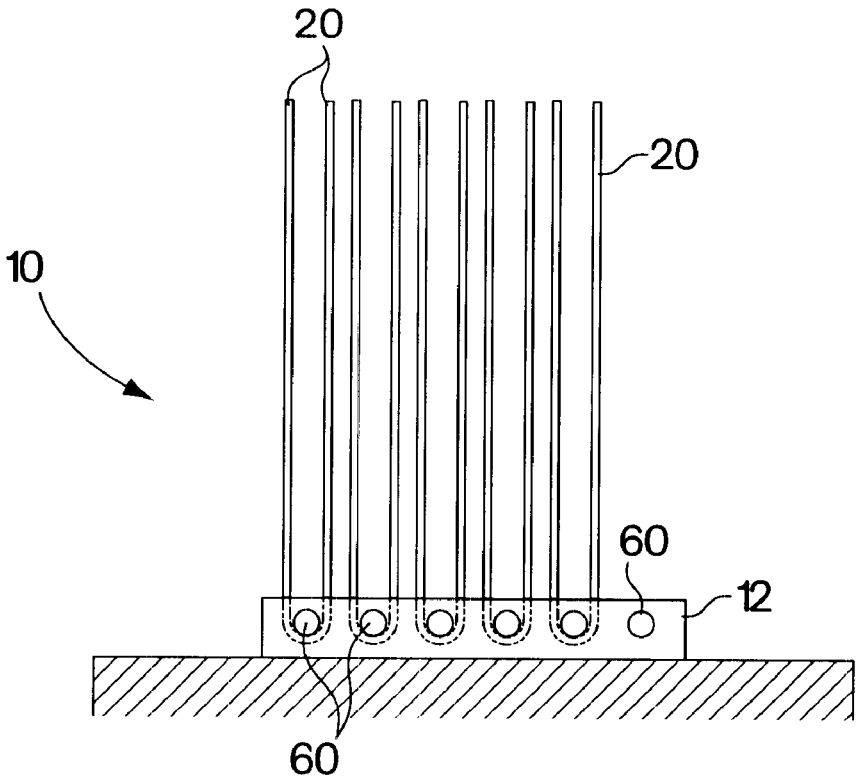
FIG. 6 is a side elevational view of a further embodiment of the present invention showing it in its inverted orientation.

A yet further embodiment of the present invention comprises the frame 12 in a lowermost orientation, supporting the flexible webs 20 in an "upstanding" manner in openings 60 in that frame 12, as shown in FIG. 6. The resiliently flexible webs 20 may be inserted as needed into the openings 60 to permit the learning of a forcefull follow-through of a club or bat all the way across those webs 20, teaching the proper swing techniques of a skilled athelete.

Thus, what has been shown is a unique swing trainer apparatus, which permits the individual sport player to train by himself or herself to develop muscular control and maximum power in his/her follow-through in the arcuate swing of a racquet, bat, club, or stick necessary to properly play many sports. The swing trainer apparatus is adaptable to beginning level players as well as seasoned veterans, by adding or removing parallel rows of downwardly supported web members of elongated flexible material from the support rods extending across the frame. Articulation of the swing trainer apparatus by an overhead support mechanism permits a random motion to the swing trainer apparatus, thus additionally training the player in foot and body movement and concentration in addition to the swing follow through.

I claim:

1. A swing trainer apparatus for the teaching of a sport player the power follow-through of a swing to hit a ball or puck, said swing trainer apparatus comprising: a supportable frame; a plurality of club or bat swing-resisting webs supported by said frame; a swing zone defined by said plurality of supported swing-resisting webs to permit a player to swing a club or bat against and through said supported swing-resisting webs to improve the swing and power of said player as a club or bat is swung against said supported swing-resisting webs; wherein said webs are comprised of strips of an elongated flexible material; wherein said frame includes a support arrangement extending thereacross and wherein said strips of web material are distributed thereon in a spaced apart manner.

2. The swing trainer apparatus as recited in claim 1, wherein said support rods are arranged across said frame in a parallel and spaced apart manner.

3. The swing trainer apparatus as recited in claim 1, wherein said support rods are removably replacable in said frame.

4. The swing trainer apparatus as recited in claim 1, wherein said webs are selected from the group comprised of: strips of plastic, strips of woven material, rope and leather.

5. The swing trainer apparatus as recited in claim 1, including an arrangement of overhead support lines attached to said frame for supporting said swing trainer apparatus from an overhead support.

6. The swing trainer apparatus as recited in claim 5, wherein said arrangement of overhead support lines extend outwardly and away from said frame to an overhead securement.

7. The swing trainer apparatus as recited in claim 5, wherein said overhead support is movable to provide a moving target into which a player may swing.

8. The swing trainer apparatus as recited in claim 7, wherein said overhead support comprises an articulable arm which is swingable about an arc, up and down and left and right to provide said swing trainer apparatus as a movable sweet-spot target.

9. The swing trainer apparatus as recited in claim 7, wherein said overhead support comprises a movable trolley controllably arranged in a track.

10. A method of improving the swing and power follow-through of a player using a bat, racquet, club or stick against a ball or puck, comprising the steps of:

arranging a three-dimensional array of bat, racquet, club or stick swing-resisting web members supported by a frame, which swing resisting web members provide a swing-resisting sweet spot target;

swinging said bat, racquet, club or stick against said sweet spot of said swing-resisting web members by a holder of said bat, racquet, club or stick, to teach said holder to swing and follow all the way through said array of said swing-resisting web members.

11. The method as recited in claim 10, including the step of:

adding a row of web members to said array of web members supported by said frame.

12. The method as recited in claim 10, including the step of:

removing a row of web members from said array of web members supported by said frame.

13. The method as recited in claim 10, including the step of:

changing the physical characteristics of adjacent web members supported on said frame to impart different resistance to a swing through said web members.

14. The method as recited in claim 10, including the step of:

moving said frame supporting said web members so as to provide a moving sweet spot target to said holder of said club, bat, racquet or stick.

15. The method as recited in claim 14, wherein said frame is supported on an articulable arm member arranged to be swingable so as to provide movement to said webs.

16. The swing trainer apparatus as recited in claim 1, wherein said webs are arranged in an upstanding manner on said frame.

* * * * *